US009650870B2

(12) United States Patent
Jenkins et al.

(10) Patent No.: US 9,650,870 B2
(45) Date of Patent: May 16, 2017

(54) ELECTRONIC COMBINED LOAD WEAK LINK

(75) Inventors: Peter Jenkins, Nesbru (NO); Ola Ystgaard, Oslo (NO); Harald Holden, Asker (NO)

(73) Assignee: STATOIL PETROLEUM AS, Stavanger (NO)

( * ) Notice: Subject to any disclaimer, the term of this patent is extended or adjusted under 35 U.S.C. 154(b) by 928 days.

(21) Appl. No.: 13/643,950

(22) PCT Filed: Apr. 28, 2011

(86) PCT No.: PCT/EP2011/056725

§ 371 (c)(1),
(2), (4) Date: Dec. 28, 2012

(87) PCT Pub. No.: WO2011/135021

PCT Pub. Date: Nov. 3, 2011

(65) Prior Publication Data

US 2013/0093179 A1 Apr. 18, 2013

(30) Foreign Application Priority Data

Apr. 28, 2010 (NO) ..... 20100612

(51) Int. Cl.
*E21B 41/00* (2006.01)
*E21B 17/01* (2006.01)
(Continued)

(52) U.S. Cl.
CPC ..... *E21B 41/0021* (2013.01); *E21B 17/017* (2013.01); *E21B 17/06* (2013.01); *E21B 33/038* (2013.01)

(58) Field of Classification Search
CPC ..... E21B 17/01; E21B 17/06; E21B 33/038
(Continued)

(56) References Cited

U.S. PATENT DOCUMENTS 3,325,190 A * 6/1967 Eckert et al. ..... 285/18
4,431,215 A 2/1984 Moyer
(Continued)

FOREIGN PATENT DOCUMENTS

DE 28 32 220 A1 1/1980
SU 579946 A3 11/1977
(Continued)

*Primary Examiner* — Matthew R Buck
*Assistant Examiner* — Aaron Lembo
(74) *Attorney, Agent, or Firm* — Birch, Stewart, Kolasch & Birch, LLP

(57) ABSTRACT

A safety device and method for protection of the integrity of well barrier(s) or other interfacing structure(s) at an end of a riser string or a hose includes a releasable connection in the riser string or hose, the releasable connection arranged to release or disconnect during given predefined conditions in order to protect the well barrier(s) or other interfacing structure(s). The safety device safety device includes at least one sensor to monitor at least one of tension loads, bending loads, internal pressure loads and temperature. The sensor provides measured data relating to at least one of tension loads, bending loads, internal pressure loads and temperature. An electronic processing unit receives and interprets the measured data from the sensor. An electronic, hydraulic or mechanical actuator or switch is arranged to receive a signal from the electronic processing unit and initiate a release or disconnect of the releasable connection.

20 Claims, 16 Drawing Sheets

(51) Int. Cl.
*E21B 17/06* (2006.01)
*E21B 33/038* (2006.01)

(58) Field of Classification Search
USPC ..... 166/340, 365, 367
See application file for complete search history.

(56) References Cited

U.S. PATENT DOCUMENTS

| | | | | |
|---|---|---|---|---|
| 4,823,879 | A * | 4/1989 | Brammer et al. | 166/341 |
| 5,657,823 | A * | 8/1997 | Kogure et al. | 166/340 |
| 5,951,061 | A * | 9/1999 | Arlt et al. | 285/94 |
| 5,978,739 | A * | 11/1999 | Stockton | E21B 19/002 701/116 |
| 6,568,476 | B1 | 5/2003 | Andersen | |
| 6,672,390 | B2 * | 1/2004 | Azancot | 166/341 |
| 7,080,689 | B2 * | 7/2006 | Guesnon et al. | 166/355 |
| 7,328,741 | B2 * | 2/2008 | Allen et al. | 166/64 |
| 7,926,579 | B2 * | 4/2011 | Sbordone et al. | 166/384 |
| 8,714,263 | B2 * | 5/2014 | Sundararajan | E21B 33/064 166/338 |
| 2005/0100414 | A1 | 5/2005 | Salama | |
| 2006/0065401 | A1 | 3/2006 | Allen et al. | |
| 2008/0314597 | A1 | 12/2008 | Sbordone et al. | |
| 2011/0284237 | A1 * | 11/2011 | Baugh | 166/365 |
| 2012/0031622 | A1 * | 2/2012 | Carlsen et al. | 166/355 |

FOREIGN PATENT DOCUMENTS

| | | | |
|---|---|---|---|
| SU | 712037 | A3 | 1/1980 |
| WO | WO 03/064809 | A1 | 8/2003 |

* cited by examiner

Normal operation

Tc = Tension capacity
Mc = Moment capacity

ELECTRONIC COMBINED LOAD WEAK LINK

TECHNICAL FIELD OF INVENTION

The present invention relates to a safety device for emergency disconnect of a riser or hose, typically in relation with well intervention riser systems, completion/work over (C/WO) riser systems etc. The technology/concept may also be applicable for production risers including flexible risers and also offshore offloading systems and other riser or hose systems in use offshore today.

BACKGROUND

The conventional riser disconnect systems are based on either an operator initiated emergency disconnect system requiring the active intervention of an operator (by the push of a button) and automatic disconnect systems based on a weak link placed in the riser system which is designed to fail mechanically in an emergency scenario before any other critical components fail. Such disconnect systems are typically referred to as "weak links".

The key purpose of a weak link is to protect the well barrier(s) or other critical structure(s) interfacing the riser in accidental scenarios, such as heave compensator lock-up or loss of rig position which may be caused by loss of an anchor (dragged anchor), drift-off, where the rig or ship drifts off location because the rig or ship loses power, or drive-off, which is a scenario where the dynamic positioning system on the rig or ship fails for any reason causing the ship to drive off location in any arbitrary direction. In such accidental scenarios operators will have very limited time to recognize that an accident is happening and to trigger a release of the riser from the well or other critical structure(s) attached to the riser. In such accidental scenarios where the operators do not have reasonable time to react to an accident the weak link shall ensure that the integrity of the well barrier(s) or other critical interfacing structure(s) is/are protected.

When a riser is connected to a wellhead, a X-mas tree (or a lower riser package with a X-mas tree) is landed and locked onto the wellhead. The riser system is then fixed to the well on the seabed in the lower end. The upper end of the riser is typically suspended from a so-called heave compensator 1 and/or riser tensioning system in the upper end as illustrated in FIG. 1. The riser tensioning system applies top tension to the riser 2 and is connected to a heave compensator 1 which compensates for the relative heave motion between the vessel 3 (e.g. a rig or a ship) moving in the waves and the riser fixed to the seabed 4. The heave compensator system 1 is typically based on a combination of hydraulic pistons and pressurized air accumulators (not shown). The hydraulic pistons are driven actively up and down by a hydraulic power unit in order to compensate for the vertical motion of the vessel 3 in the waves. The air accumulators are connected to the same system and are used to maintain a relatively constant tension in the system. This is done by suspending the risers from cylinders resting on a pressurized air column, where the pressure is set according to the load in the system. The volume of the air accumulators and the stroke of the cylinders will then define the motion hysteresis and therefore the tension in the system as the vessel 3 moves vertically in the waves.

A compensator lock-up refers to a scenario where the heave compensation system fails, causing the heave compensator cylinders to lock and thereby failing to compensate for the heave motion between riser 2 and vessel 3, ref. FIG. 2. This may result in snag loads and excessive tension forces on the riser 2. Such snag loads may cause damage to well barrier(s) 5 or other interfacing structure(s). A weak link in the riser 2 will, when properly designed, protect the well barrier(s) 5 from damage in case of a compensator lock-up occurring. However, one challenge is that during normal operation the vessel 3 may be positioned within a certain operational window above the well on the seabed 4. This gives a relative angle $\alpha$ between the vessel 3 and the well on the seabed 4. This angle $\alpha$ means that any tension load in the riser 2 will also cause bending moments in the well barrier(s) 5. To properly protect the well barrier(s) 5 in case of heave compensator lock-up, a weak link will need to release before the combined load from riser tension and bending moment due to vessel 3 offset damages the well barrier(s) 5.

Loss of position occurs when the vessel 3 fails to maintain its position within defined boundaries above the wellhead. Anchored vessels 3 usually experience loss of position caused by loss of one or more anchors. For dynamically positioned (DP) vessels, loss of position is normally caused by DP failure or by operator error causing the vessel 3 to drive-off from its intended position. In a drift-off scenario the vessel either does not have sufficient power to stay in its position given the current weather conditions, or vessel power is lost and the vessel will drift off in the direction of the wind, waves and currents. All such accidental scenarios result in excessive vessel 3 offset relative to well barrier(s) 5, ref. FIG. 3. When the position of the vessel moves outside the allowable boundaries, the resulting riser angle $\alpha$ in combination with riser tension will induce high bending moments in the lower and upper part of the riser 2. Furthermore as the relative distance between the vessel 3 and the well barrier(s) 5 on the seabed increases, the heave compensator cylinder will stroke out to compensate an otherwise increase in tension. Subsequently the heave compensator 1 will stroke out, leading to a rapid increase in the riser tension. When this occurs the relative angle $\alpha$ between the well barrier(s) 5 on the seabed 4 and the vessel 3 will have increased significantly and the rapid tension increase will cause high bending moments in the well barrier(s) 5, ref. FIG. 3.

To protect the well barrier(s) 5 in the mentioned accidental scenarios, a weak link needs to disconnect the riser 2 from the well barrier(s) 5 prior to exceeding the combined load capacity of the well barrier(s) 5 in tension and bending, see FIG. 6.

Exceeding the load capacity of the well barrier(s) 5 may involve damage of the well head, damage inside the well, damage on the riser 2 etc., all of which are considered to be serious accidental scenarios with high risk towards personnel and the environment.

Damage of the well barrier(s) 5 may result in costly and time consuming repair work, costly delays due to lack of progress in the operation, and last, but not least, environmental and human risks in the form of pollution, blow-outs, explosions, fires, etc. The ultimate consequence of well barrier damage is a full scale subsea blow-out, with oil and gas from the reservoir being released directly and uncontrollably into the ocean. If the down-hole safety valve should fail or be damaged in the accident, there are no more means of shutting down the well without drilling a new side well for getting into and plugging the damaged well.

The challenges with existing weak link designs are related to the combination of fulfilling all design requirements (safety factors, etc.) during normal operation of the system, and at the same time ensuring reliable disconnect of the system in an accidental scenario.

The most common weak link concepts today rely on structural failure in a component or components. Typical designs involve a flange with bolts that are designed to break at a certain load, or a pipe section that is machined down over a short length to cause a controlled break of the riser in that location.

Most conventional weak links that are in use today only rely on tension forces, i.e. a given weak link is designed to break at a certain, pre-defined tension load. However, the emergency situations that arise do not involve tension forces alone. In the case of e.g. a drift-off, there will be significant bending moments introduced into the well barrier(s) 5 in addition to the tension forces. Even in a heave compensator lock-up scenario, bending moments acting on the well barrier(s) 5 may be significant due to the rig/vessel offset within the allowable operation window. It is not uncommon that the weather window for an operation is limited because the weak link can only accommodate a certain vessel offset in normal operation as illustrated by a typical operational diagram shown in FIG. 4. Vessel station keeping ability above the well will be reduced with increasing winds and waves and normal variations in the position of the rig above the well will increase. If the offset exceeded a certain limit the weak link will not protect the well barrier(s) 5 in case of a heave compensator lock-up. Therefore, the ability of the weak link to fail due to bending may affect the weather window of the operation.

Furthermore, the internal pressure in a riser, which may vary from atmospheric up to 10,000 psi or higher, has a significant impact on the loads experienced by the riser 2, the well barrier(s) 5 and on the weak link.

When the internal pressure is greater than the external pressure the riser component will experience increased axial tension and hoop tension. The axial tension caused by internal overpressure is often referred to as the end cap load [N] (=internal area·internal overpressure). Internal pressure causing the pipe to fail in hoop tension is referred to as the burst pressure.

The effect of internal pressure causes a dilemma in weak link designs based on structural failure:

1. The weak link needs to be dimensioned for operation under full pressure with normal safety margins.
2. The tension and bending capacity of the well barrier(s) are reduced by internal pressure.
3. In some operations the well barrier(s) will be pressurized, but the riser with the weak link will be unpressurised.
4. In an accidental scenario the weak link must release before the well barrier(s) is(are) damaged, even when the well barrier(s) is(are) pressurized and the weak link is not pressurized.

Point 4 above is often challenging to achieve in the design of a weak link based on structural failure because the band between minimum capacity in normal operation and maximum break load in an accidental scenario becomes too wide. In some cases with high pressure system it may not be practically achievable to design a weak link based on structural failure.

FIG. 5 illustrates the challenges linked to designing a weak link which is based on structural failure, e.g. the conventional breaking of weakened flange bolts or the like. The illustration shows a system where the nominal system tension in the weak link is 100 T (1 T=1 ton=1000 kg). The system shall work under pressure and the end cap effect of the pressure increases the tension to more than 200 T which the weak link needs to be designed for. In the design of the weak link, safety factors and spread in material properties has to be allowed for thus increasing the actual capacity of the part to more than 400 T. The weak link will normally also have to accommodate a certain bending moment in normal operation, which in the illustration mentioned above, has increased the structural capacity of the weak link to around 500 T. This means that in the example above, a weak link designed for a maximum operational tension of 100 T and a given bending moment, cannot be designed with a breaking load less than 500 T. In some cases the gap between design load and the minimum possible breaking load is greater than the allowable capacity in the well barrier(s), thus requiring a reduction in the operational capacities, which again reduces the operational envelopes. As the examples shows, the fact that the weak link shall be designed for full pressure, but at the same time shall work as a weak link when there is no pressure in the system, will for a high pressure system contribute significantly to the gap between the operational design load and the minimum breaking load in a weak link based on structural failure.

In additional, to the technical challenges related to existing weak link solutions based on structural failure, there are also schedule and cost challenges related to the conventional systems. A weak link based on structural failure requires a comprehensive qualification program for each project and typically imposes stringent requirements on material deliveries to control material properties of the parts designed to fail. These qualification programs and the additional requirements for particular material properties are often a challenge with respect to project schedules.

FIG. 6 shows a typical capacity curve for combined loading for well barrier(s) 5 being defined by a straight line along which all safety factors in the well barrier design have been fully utilized. This line does not represent the structural failure of the well barrier(s), but indicates the calculated allowable capacity of the well barrier(s) 5. If the combined loads exceed this line there is no guarantee for the integrity of the well barrier(s), and it is likely that the barrier(s) is(are) damaged and possible leaks may occur.

FIG. 7 illustrates how the loads in the riser 2 and in the well barrier(s) 5 develop in a heave compensator lock-up, and how this relates to the capacity of the riser weak link and the capacity of the well barrier(s). The actual capacity of a weak link defined by structural failure is shown as the curved capacity curve for the riser pipe.

When the heave compensator lock-up occurs, the riser 2 will see a rapid increase in axial loading, as shown in the upper load diagram. At the same time the well barrier(s) 5 will see an increase in axial load but also in bending moment due to the rigs offset relative to the position of the well as shown in the lower load diagram by the angle $\alpha$. The challenge with current weak link design is then that with a certain rig offset the load capacity of the well barrier(s) 5 will be exceeded before the load in the riser 2 reaches the structural capacity of the weak link.

FIG. 8 shows the same type of illustration for a loss of position scenario. When the rig 3 loses its position the load in the riser 2 will initially remain constant, because the heave compensator will stroke out to maintain a constant load in the riser. Once the heave compensator 1 strokes out, the tension in the riser 2 will increase rapidly as shown in the upper load diagram. The load in the well barrier(s) 5 will also remain close to constant while the heave compensator 1 strokes out (there will be some increase in the bending loads in the barrier(s)) and when the heave compensator 1 stops the axial load in the riser 2 will increase rapidly causing very high bending loads in the well barrier(s) 5. In such accidental scenarios existing weak links relying on structural failure in a riser component will typically reach its structural capacity curve long after having exceeded the design load capacity curve of the well barrier(s).

OBJECTS OF THE INVENTION

It is an object of the present invention to provide a reliable, autonomous device which will protect the integrity of the well barrier(s) in any accidental scenario which could impose excessive tension, excessive bending or any excessive combination of tension and bending which could otherwise damage the well barrier(s).

It is an object of the present invention to provide a device and method for safe, reliable and predictable disconnect in various kinds of riser applications, e.g. drilling riser systems, well intervention risers systems, completion/work over (C/WO) riser systems, flexible production risers and offloading hoses, etc.

It is a further object of the present invention to provide a device and method for safe, reliable and predictable disconnect in various kinds of riser and hose applications, wherein the device and method provide an increased operating envelope for the riser.

It is yet a further object of the present invention to provide a device and method that fulfills all design requirements (safety factors, etc.) during normal operation, while at the same time ensuring reliable disconnect of the riser system in an accidental scenario.

Another object of the present invention is to provide a weak link that operates at maximum internal pressure and ensures release at minimum internal pressure, as well as providing a pressure balanced weak link allowing the tension, bending and failure load not to be affected by the internal pressure, thereby significantly increasing the window of operation of the riser system.

Yet another object of the invention is to provide a weak link where the release is not linked to any type of mechanical failure in the weak link, thus significantly reducing the need for project specific qualification programs to document release load.

Another object of the invention is to provide a weak link where the release limit is defined as a combined loading limit curve that can easily be adjusted on a project basis without requiring a new qualification program. This will significantly reduce lead times for preparing a weak link for a project, compared to lead times required for weak links relying on mechanical failure.

SUMMARY OF THE INVENTION

These and other objects are achieved by a safety device according to the independent claim 1, and a method according to the independent claim 17. Further advantageous features and embodiments are set out in the dependent claims.

SHORT DESCRIPTION OF THE DRAWINGS

The following is a detailed description of advantageous embodiments, with reference to the figures, where:

FIG. 1 shows a vessel 3 during a workover operation, where a rigid riser 2 is suspended from a heave compensator 1 on the rig and is rigidly attached to a wellhead (well barrier(s) 5) on the seabed. The heave compensator 1 strokes up and down to compensate for the heave motion of the vessel 3 in the waves.

Figure 1:
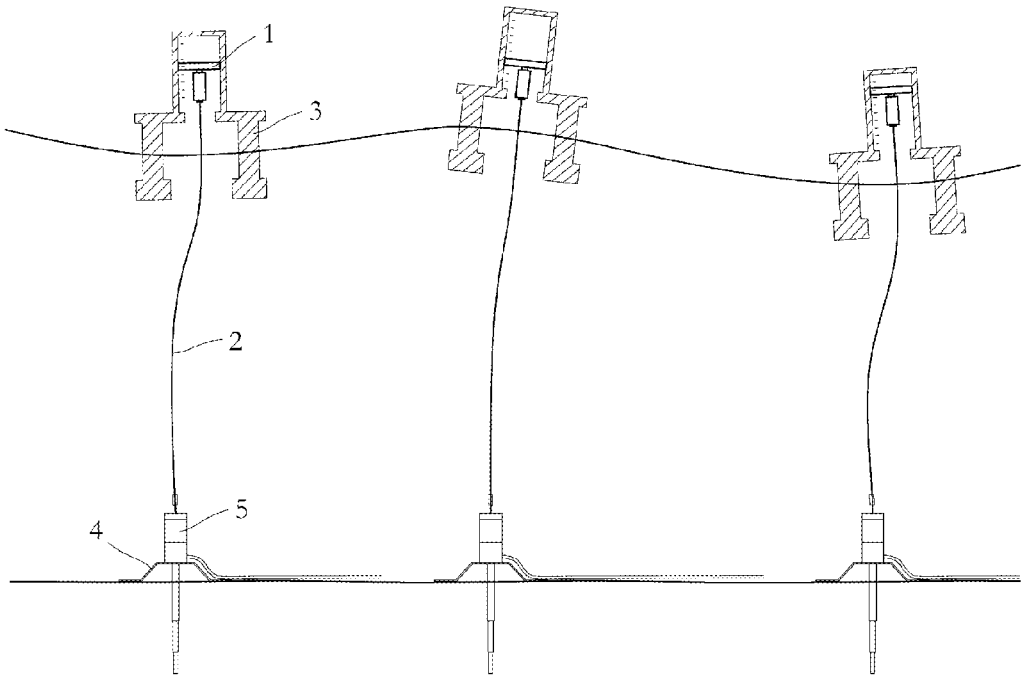
Figure 2:
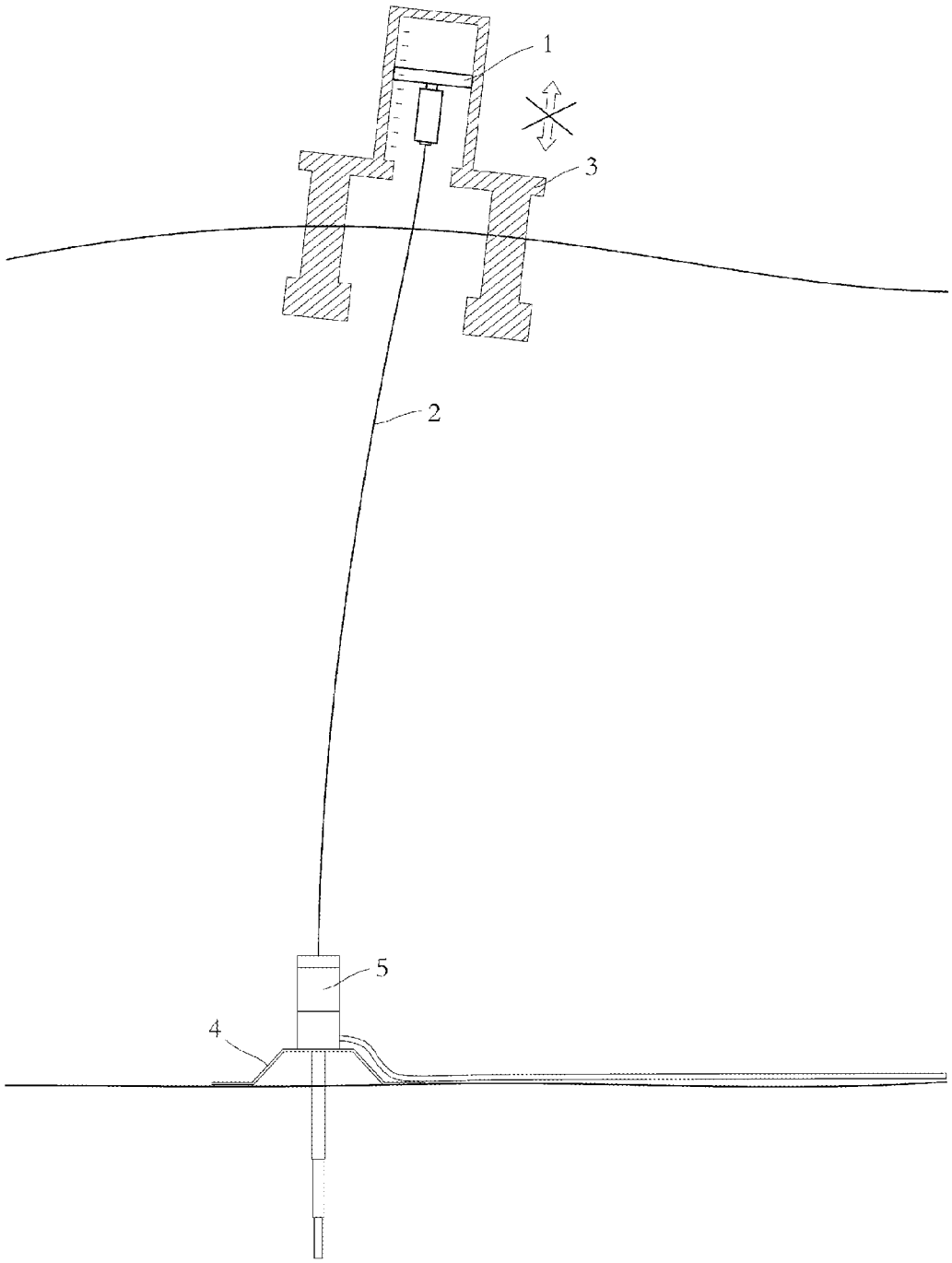
FIG. 2 illustrates the accidental scenario referred to as "heave compensator lock-up", causing a tension increase in the riser 2 when the waves lifts the vessel upward. The rapid increase in riser tension will typically result in excessive combined loading of the well barrier(s) 5.
Figure 3:
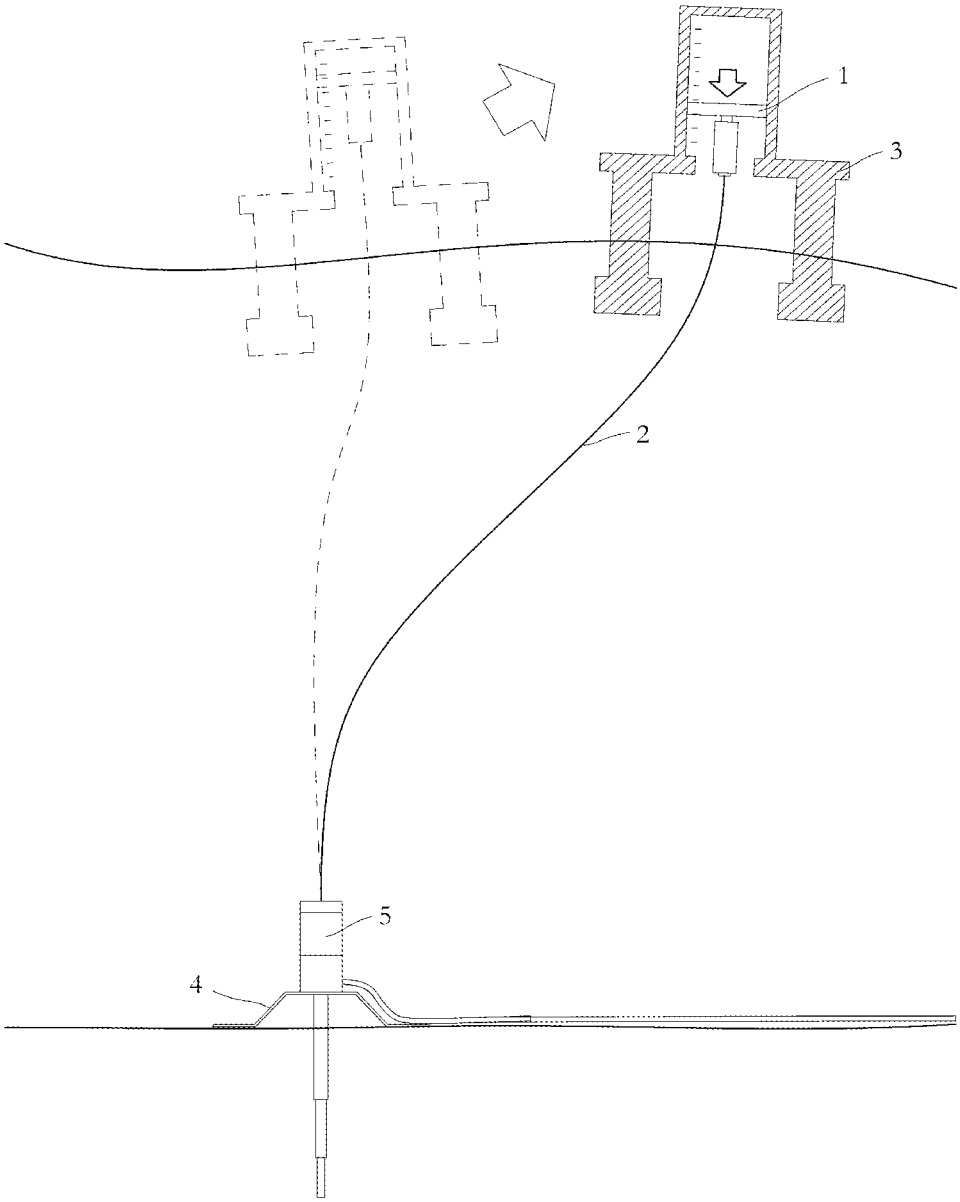
FIG. 3 illustrates the accidental scenario referred to as loss of position (due to loss of an anchor, drive-off or drift off) and how this will cause excessive bending in the well barrier(s) once the heave compensator 1 has stroked out.
Figure 4:
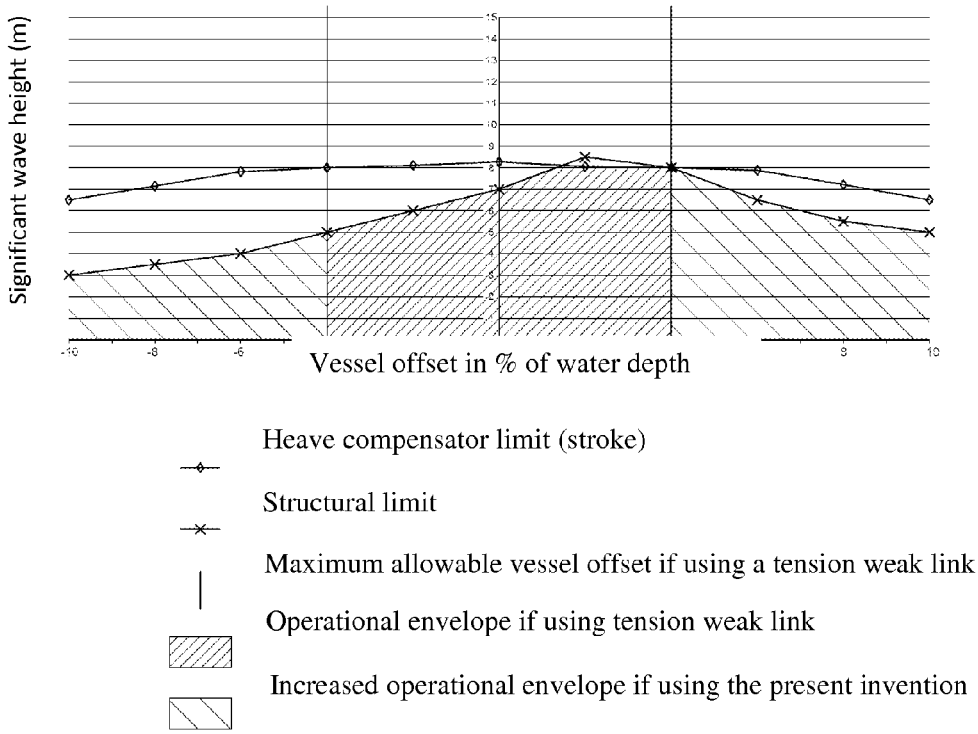

FIG. 4 shows a typical operational envelope of a vessel for a workover operation. The figure further illustrates how allowable vessel offset needs to be limited to protect the well barrier(s) from heave compensator lock-up when the weak link being used relies on failure of a riser component in tension. The figure shows how much the operational envelopes can be increased if there is a weak link that protects the well barrier(s) against any type of combined loading without regard for vessel position of system pressure.

Figure 5:
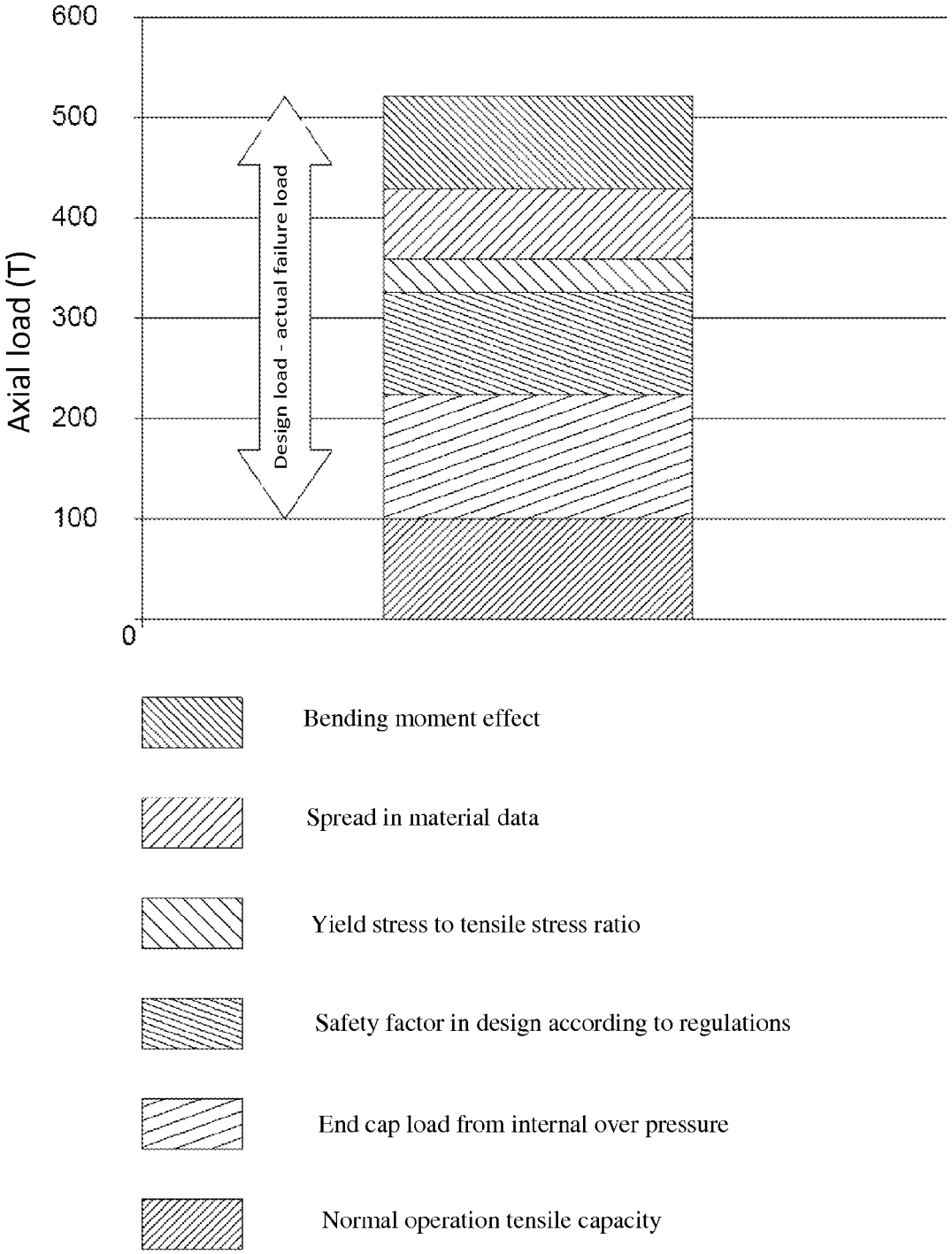

FIG. 5 illustrates the challenge of designing a weak link that fulfils all safety criteria in normal operation, but at the same time ensures a reliable release in an accidental scenario before the well barrier(s) is(are) damaged. The figure illustrates the problem related to the width of the band between the weak link fulfilling all design requirements and the structural failure capacity of the same weak link.

Figure 6:
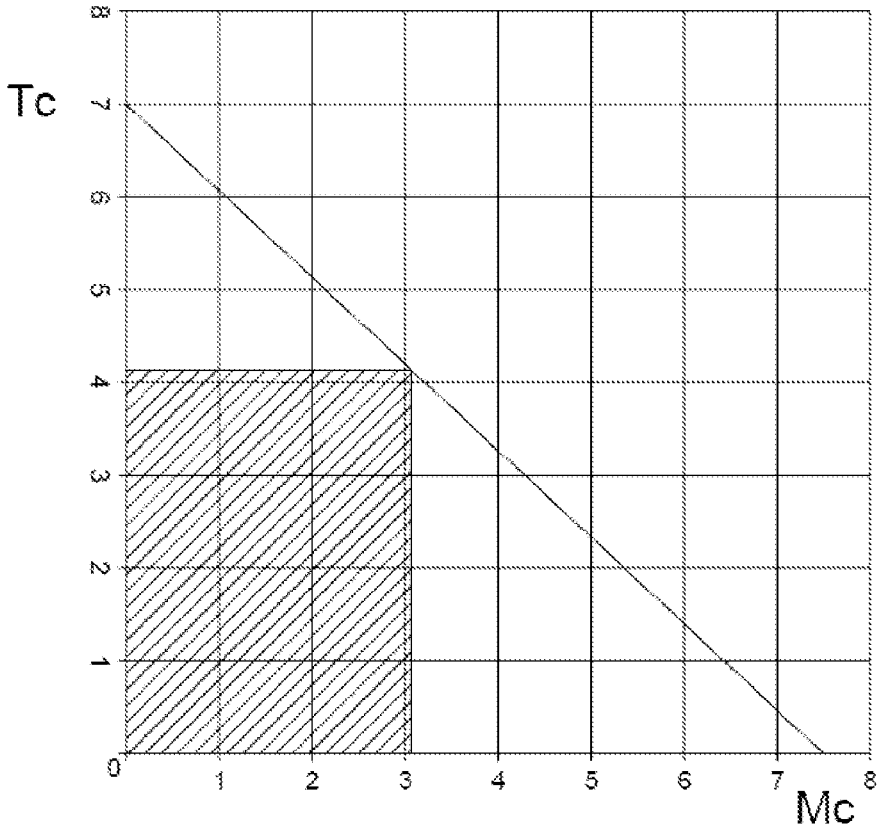

FIG. 6 illustrates a typical defined combined loading capacity curve for well barrier(s) 5. The load capacity curve does not represent an actual break of the well barrier(s), but indicates the design curve that has been used for accidental scenarios where all safety factors have been removed. When the combined load in the well barrier(s) 5 exceeds this curve there is no guarantee for the integrity of the well barrier(s), and there is a significant risk of having damaged the seals or having caused some form of permanent damage to the well barrier(s) 5.

Figure 7:
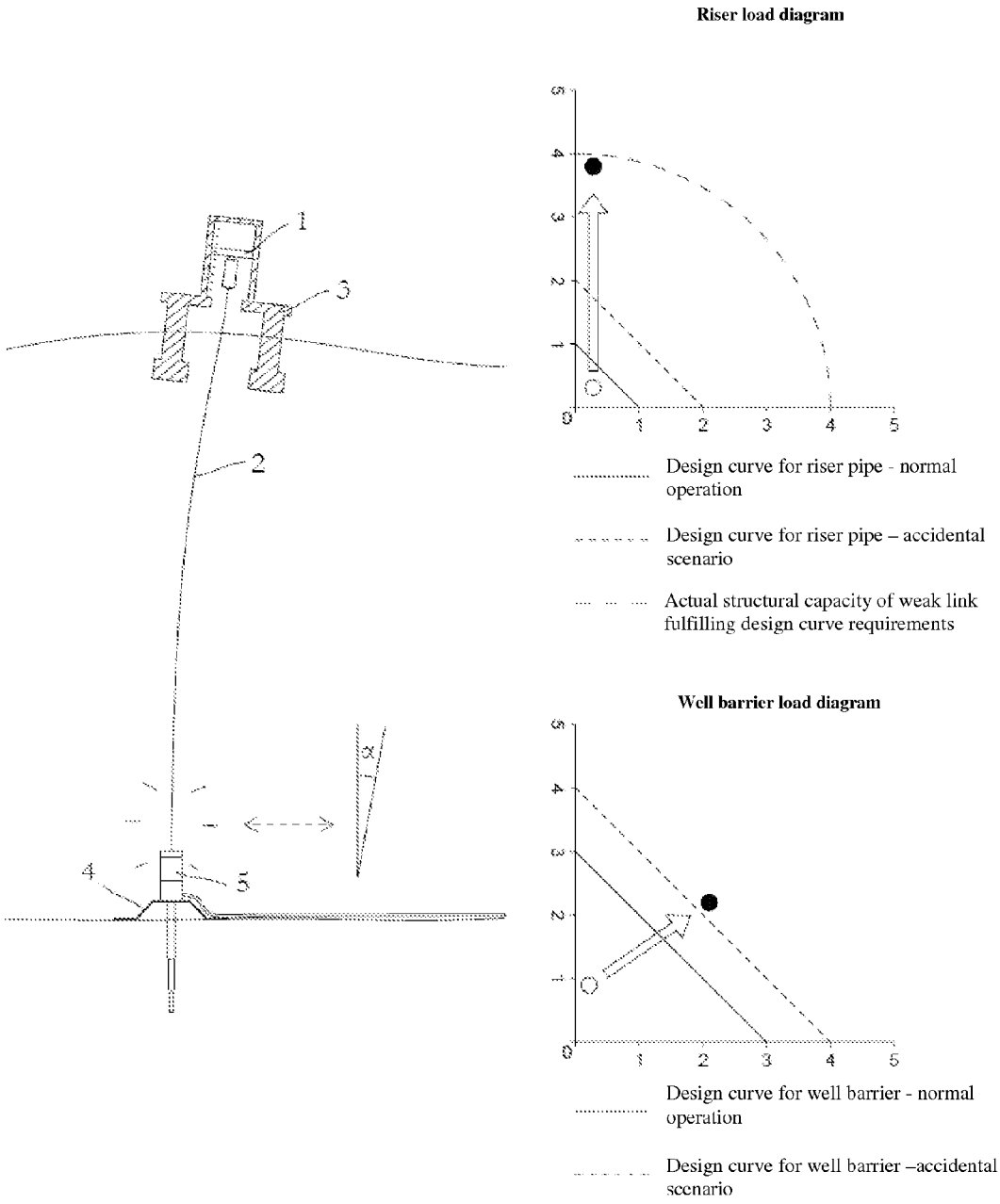

FIG. 7 illustrates the problem of using a weak link based on structural failure in a riser component to protect the well barrier(s) in case of a heave compensator lock-up. The figure shows how the combined load in the well barrier(s) 5 will exceed its capacity curve before the structural capacity of the weak link is reaches typically due to the vessel 3 offset causing the angle $\alpha$ which increases the bending loads on the well barrier(s) 5.

Figure 8:
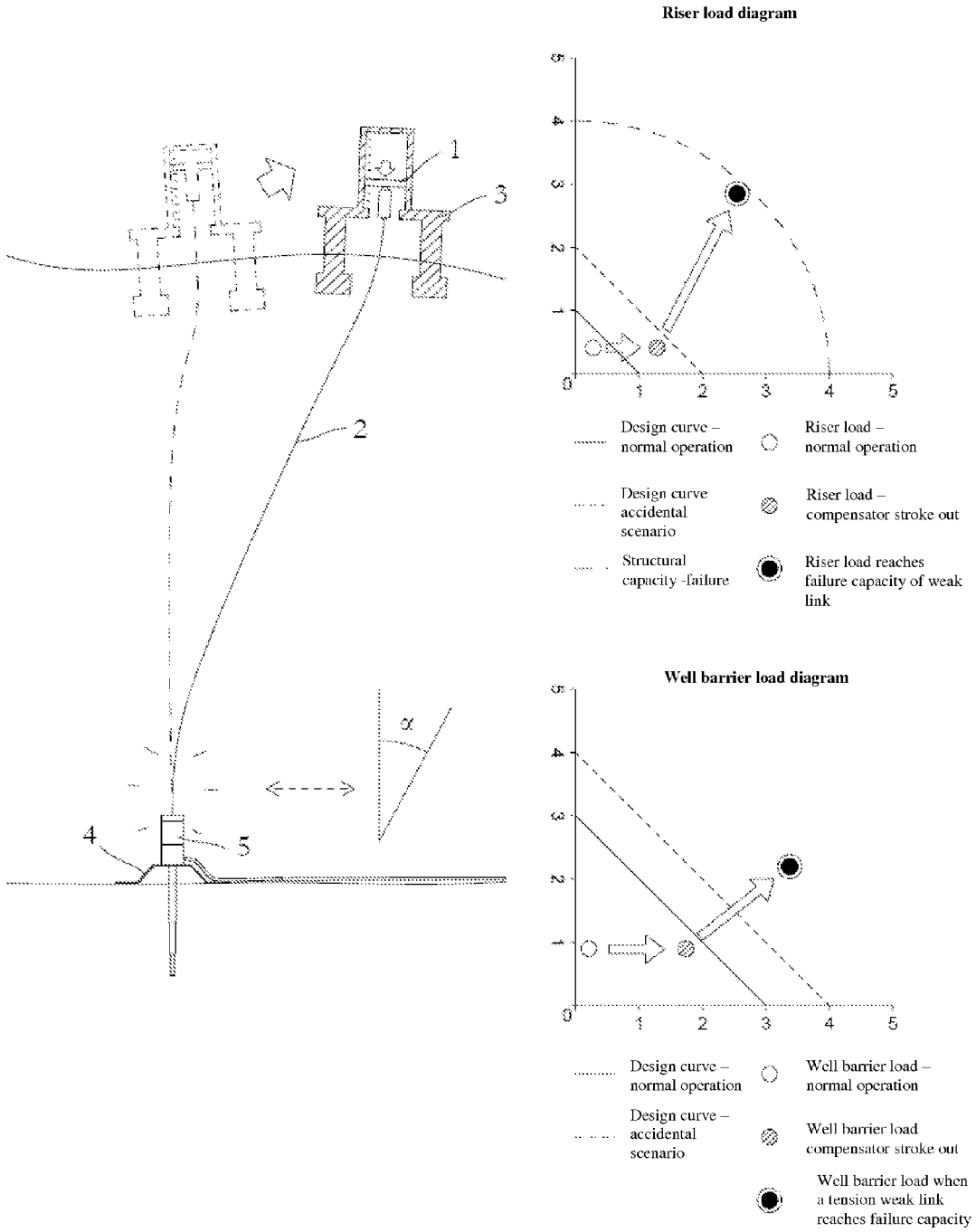

FIG. 8 illustrates the problem of using a weak link based on structural failure in a riser component to protect the well barrier(s) in case of a loss of position accidental scenario. The figure shows how the riser 2 tension remains constant until the heave compensator 1 stroke out. At this point the tension will increase rapidly and the angle $\alpha$ will cause high bending loads in the well barrier(s) 5, causing the load capacity of the well barrier(s) 5 to be exceeded long before reaching the structural failure of the riser weak link designed to fail in tension.

Figure 9:
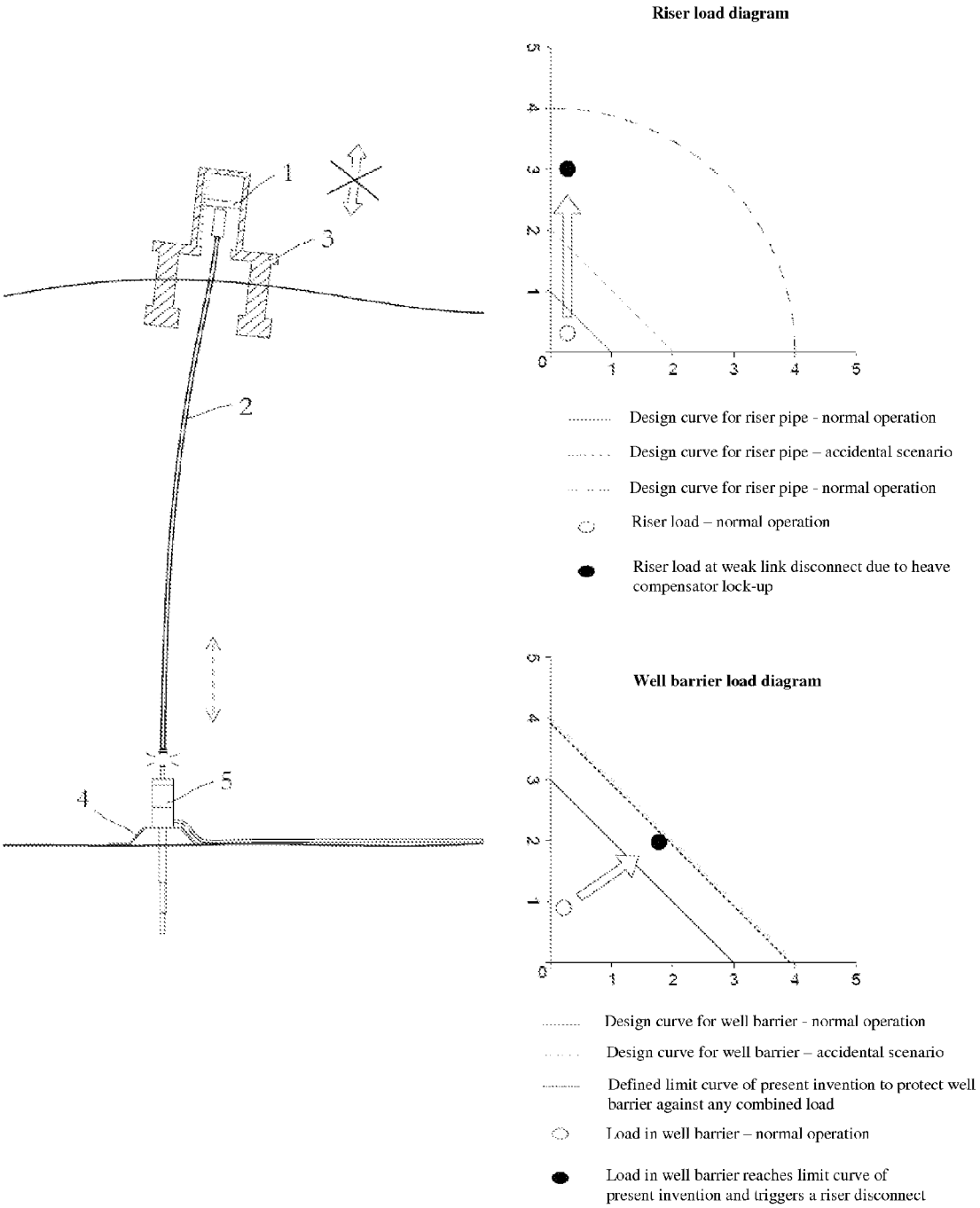

FIG. 9 shows how the present invention would work to protect the well barrier(s) 5 in case of a heave compensator 1 lock-up. The figure shows how the combined load capacity of the weak link is defined to be just within the capacity of the well barrier(s) 5. Hence for any load combination induced on the well barrier(s) 5 the invention will ensure a controlled disconnect of the riser before exceeding the capacity curve of the well barrier(s) 5.

Figure 10:
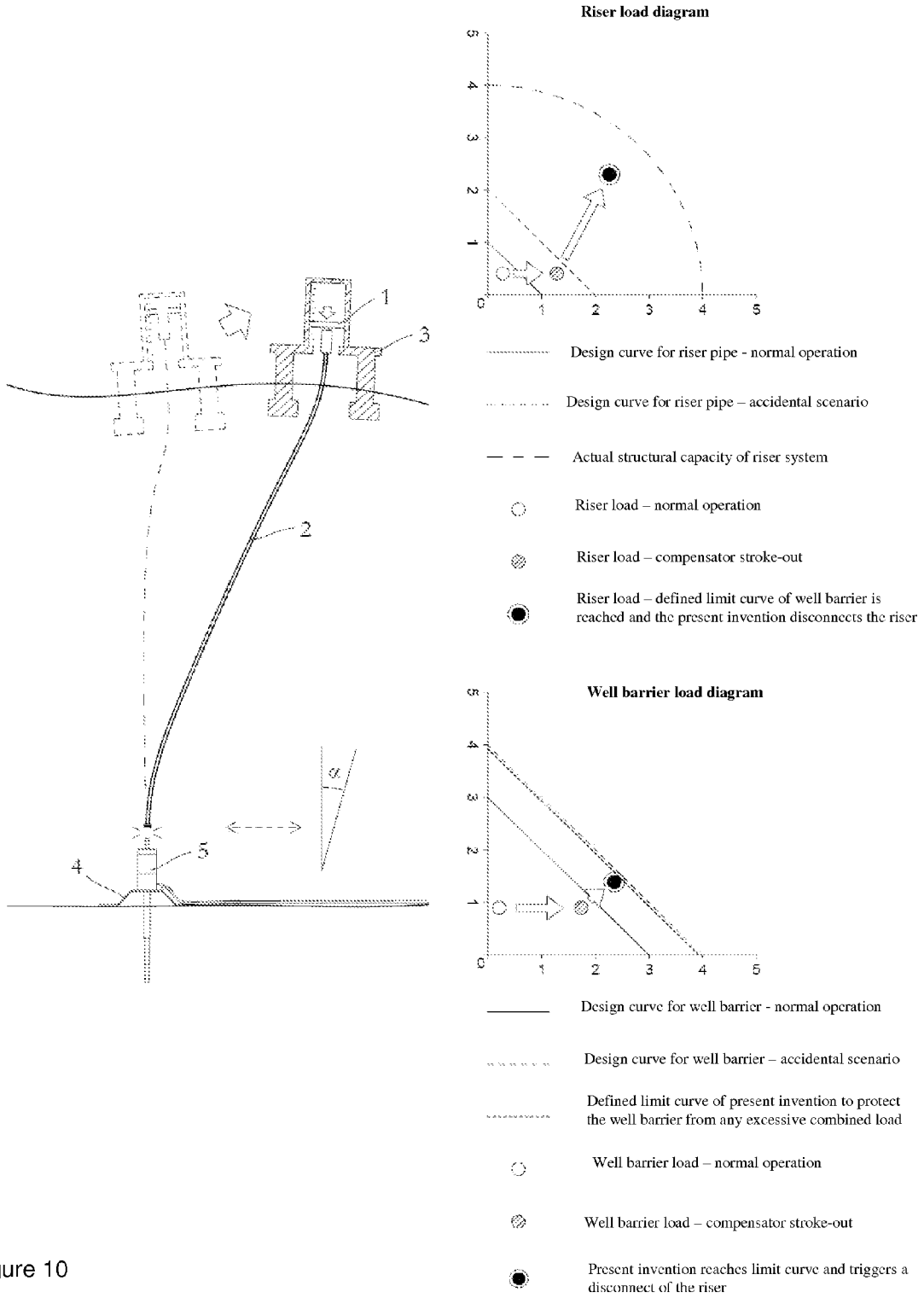

FIG. 10 shows how the present invention would work to protect the well barrier(s) 5 in case of the vessel loosing its position due to a drive-off or drift-off scenario. The figure shows how the combined load capacity of the weak link is defined to be just within the capacity of the well barrier(s) 5. Hence for any load combination induced on the well barrier(s) 5 the invention will ensure a controlled disconnect of the riser before exceeding the capacity curve of the well barrier(s) 5.

Figure 11:
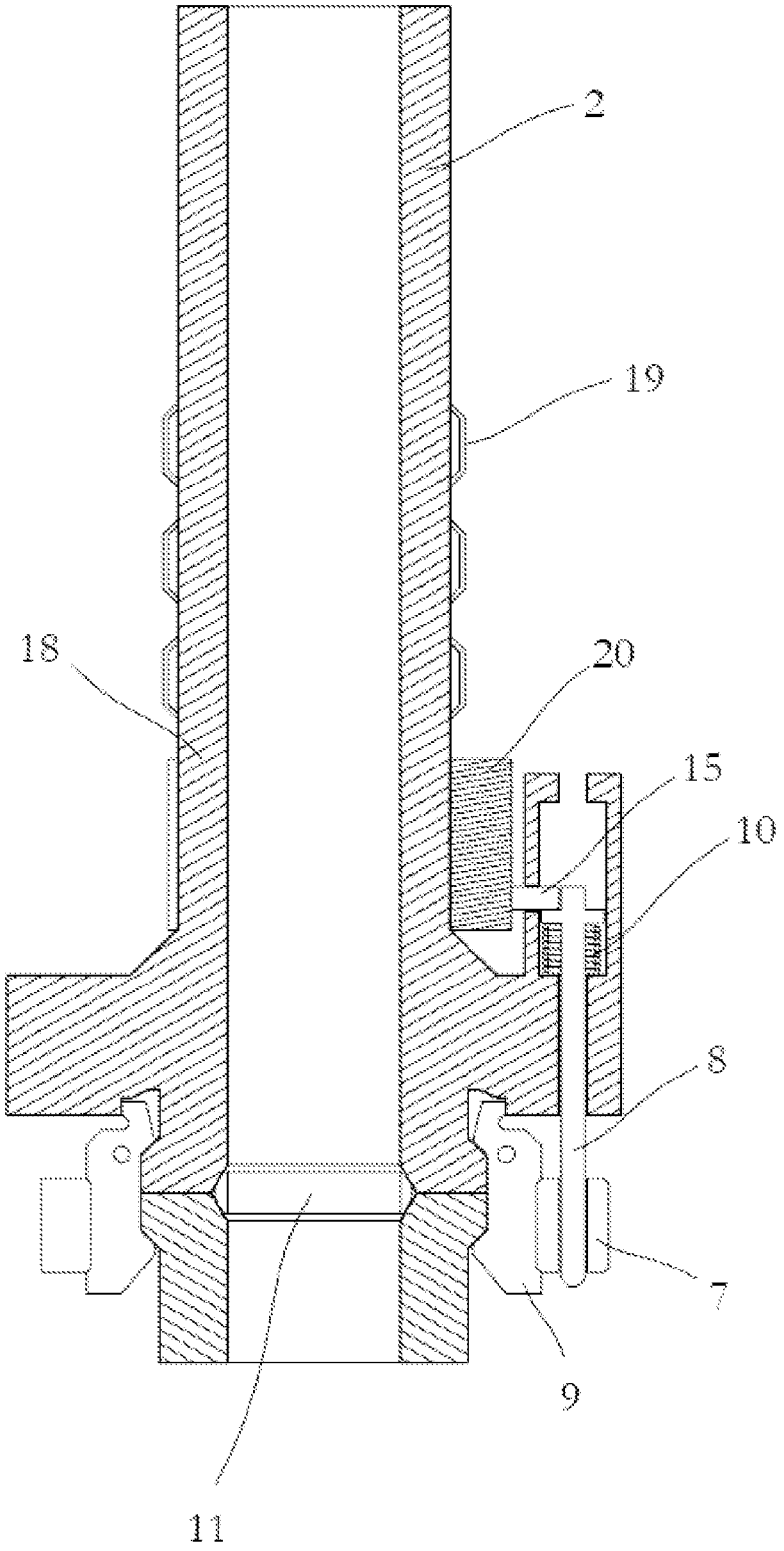

FIG. 11 shows a cross section of an embodiment of the present invention with a disconnectable connector 6, a sensor package 19 to measure combined loading in the riser 2, an electronic unit which interprets the information from the sensors and checks if the combined load in the riser is within the allowable limits and if not trigger a disconnect sequence.

Figure 12:
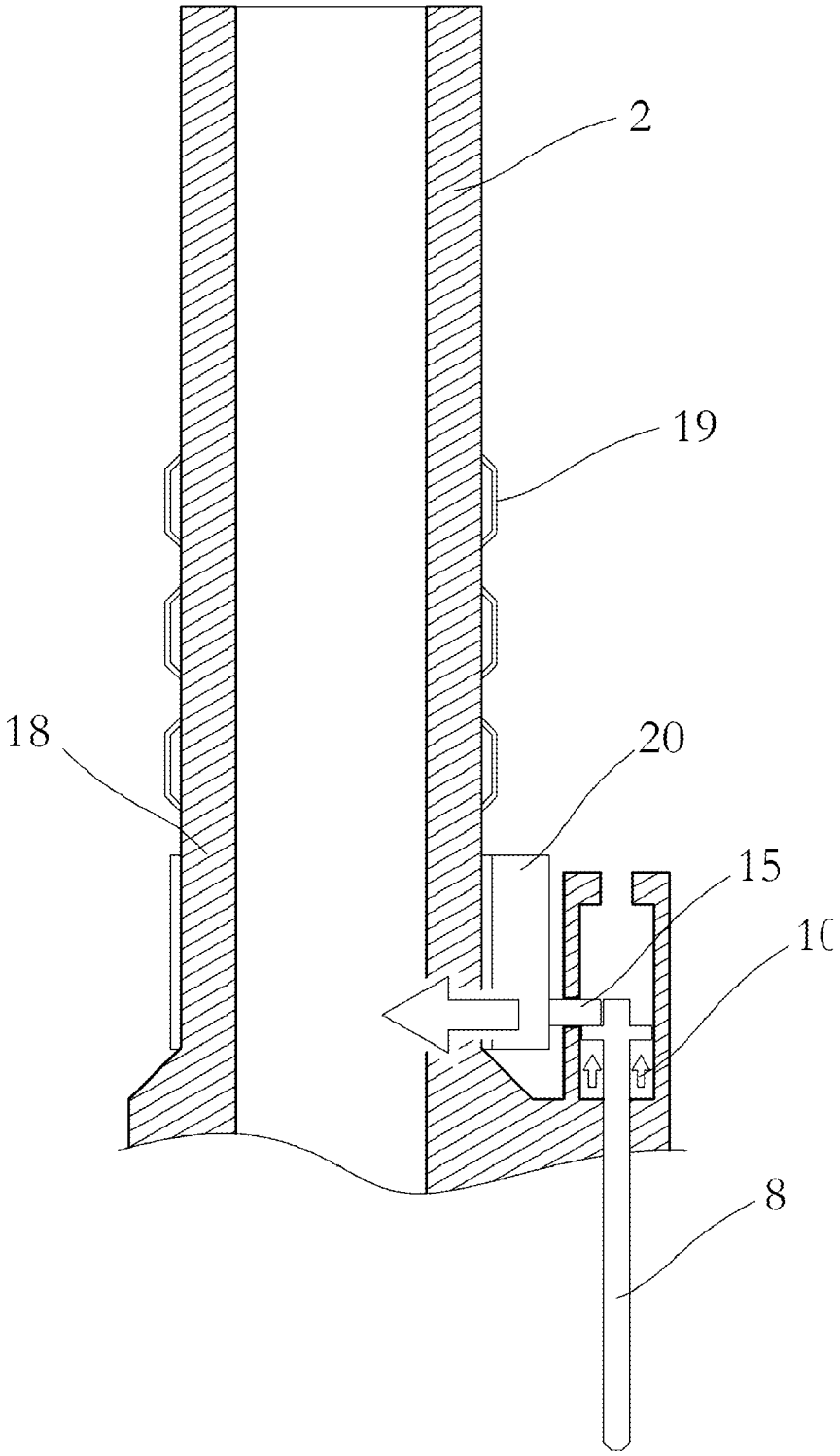

FIG. 12 illustrates the actuation sequence when releasing the locking pin 8 that holds the cam ring 7 of the connector 6 in place.

Figure 13:
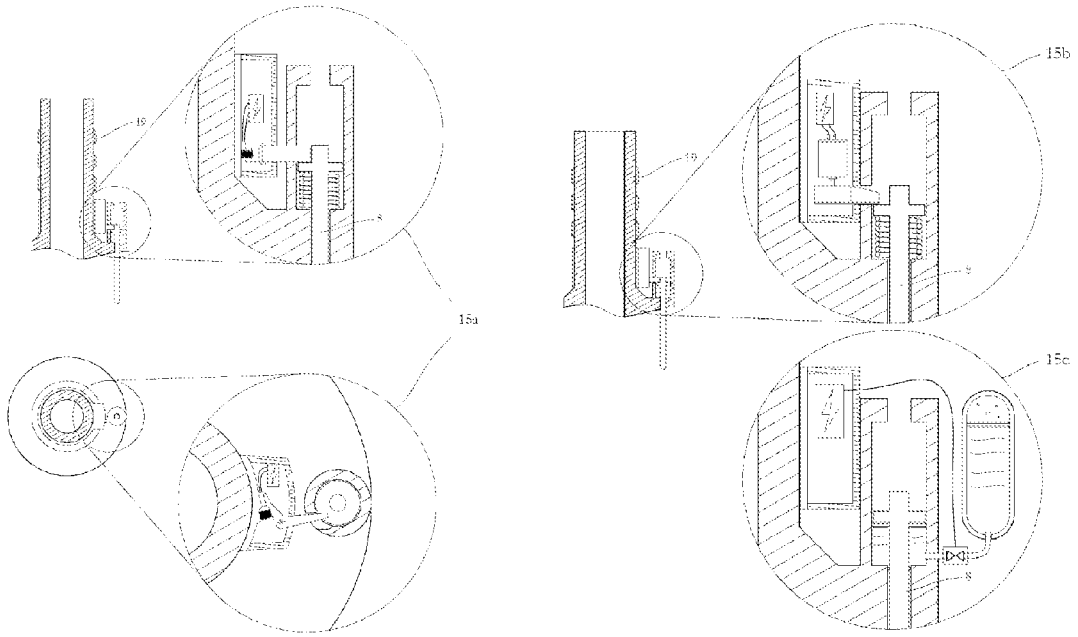

FIG. 13 shows one possible embodiment of the actuator mechanism 20 for disconnecting the releasable connector 6 and some alternative release mechanisms that may be applied. In this possible embodiment of the actuator 15*a*, a spring 10 loaded locking pin 8, which locks the connector, is supported by an over-center mechanism which is balanced by a magnet or an electrical switch. When the electronic unit 20 recognizes that the measured combined load reaches the defined combined load limit curve the switch or magnet will release the over-center mechanism. The rotation of the over-center mechanism will release the spring 10, thereby releasing the locking pin 8 to trigger a disconnect of the releasable connector 6. Alternative configurations of the actuator is shown in 15*b* with an electric motor for releasing the locking pin 8 and in 15*c* where the locking pin 8 is removed hydraulically by opening an electric valve connected to a charged accumulator.

Figure 14:
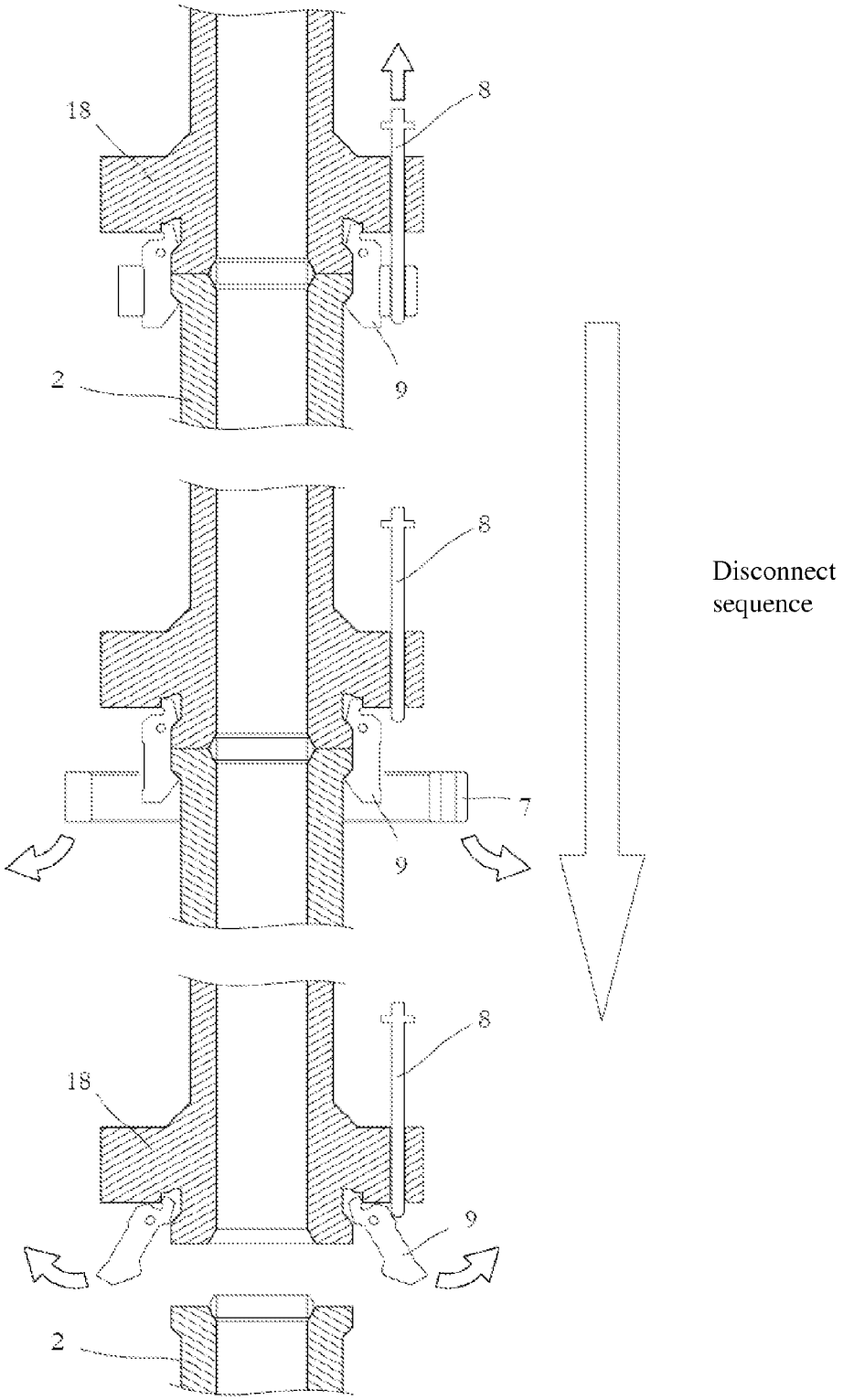

FIG. 14 shows a disconnect sequence of the preferred embodiment of the present invention from the point where the spring loaded locking pin 8 is released. The spring loaded locking pin is pulled out from the connectors cam ring 7 by the force of the preloaded spring. When the locking pin 8 is removed, the cam ring 7 will open due to the tension forces in the system or by using a leaf spring in the cam ring 7. When the cam ring opens the upper and lower part of the pipe hubs in the connector will pull apart as the connector dogs 9 are free to rotate.

Figure 15:
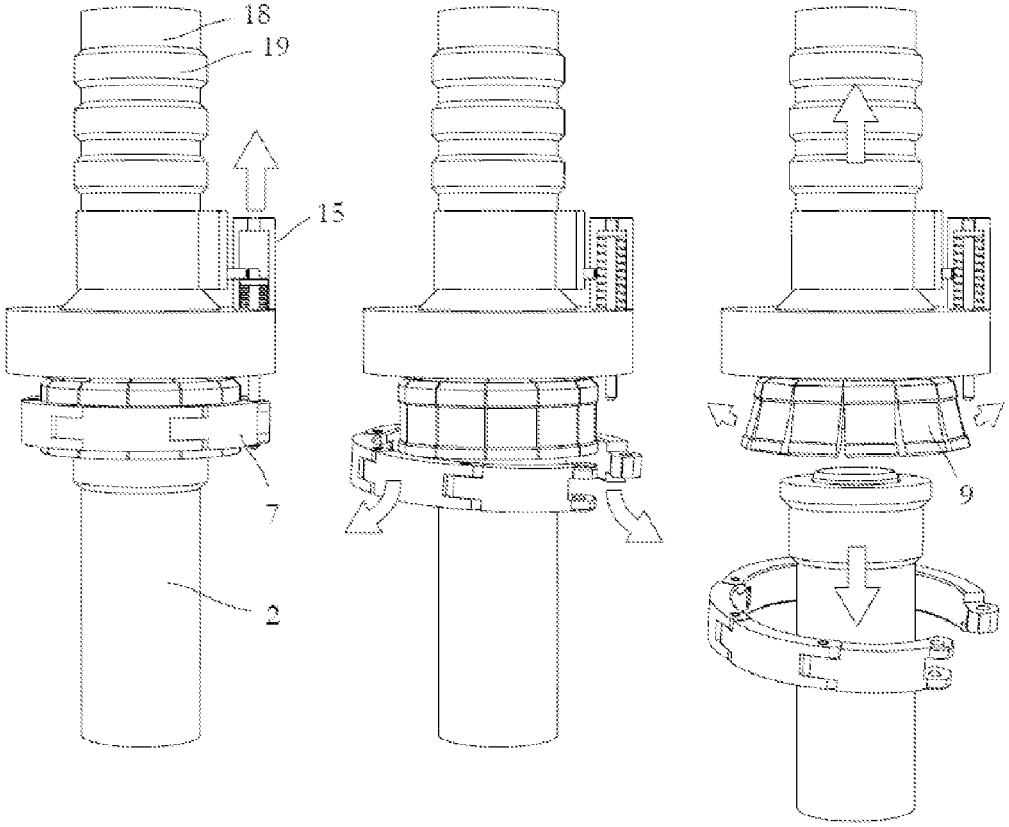

FIG. 15 shows a 3D illustration of a disconnect sequence of the preferred embodiment of the present invention.

Figure 16:
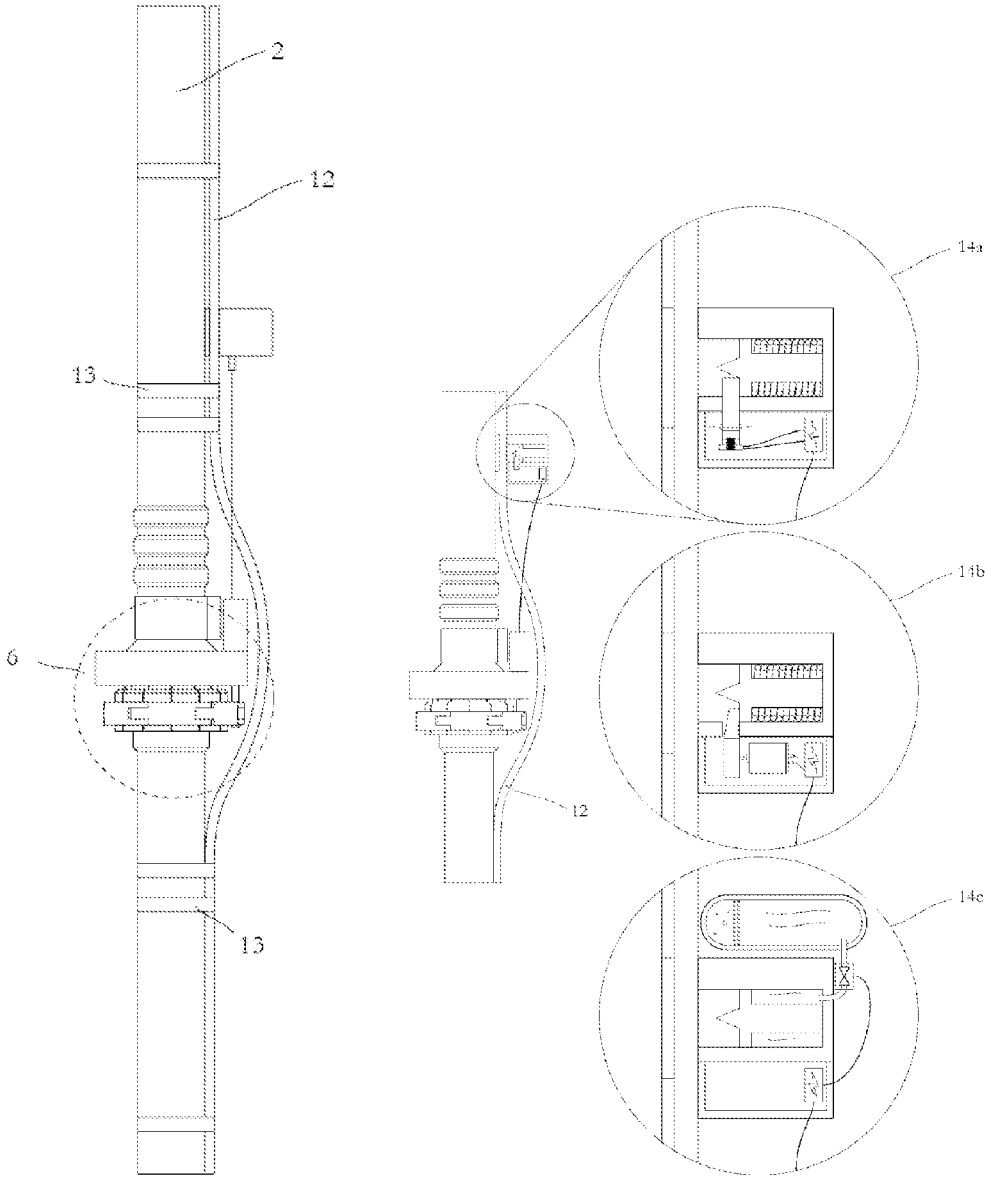

FIG. 16 illustrates alternatives for disconnecting the control umbilical when the connector disengages in an accidental scenario. In the preferred embodiment of the invention the umbilical is clamped tightly to the workover riser on either side of the electronic combined loading weak link. This method relies on the tension forces in the system to ensure that the umbilical is torn off when the connector 6 is released. An alternative solution to cut the control umbilical is illustrated in 14*a* using an over center mechanism which is triggered electronically to release a cutting ram which is charged by a mechanical spring held in place by the over center mechanism. 14*b* is a similar solution where the cutting ram is released by an electric motor rotating a disk that holds the ram in place during normal operation. 14*c* uses a hydraulic principle to move the shear ram to cut the umbilical. In this case a valve to a charged accumulator is opened electrically to push to cutting ram towards the umbilical.

DETAILED DESCRIPTION OF THE INVENTION

The safety device according to the present invention responds to bending forces in the riser system in addition to tension forces. Furthermore, the device according to the present invention preferably monitors the total combined load including tension, bending, internal pressure and/or temperature effects. All these parameters may continuously be monitored by an autonomous electronic unit 20 which evaluates the combined load on the system and ensures that the combined load is kept within pre-defined allowable limits. The electronic unit 20 compares the evaluated combined load with a pre-defined, limiting combined loading curve developed to protect the well barrier(s) 5 and which will be defined by the calculated relationship between the combined load at the position of the weak link and the combined load capacity curve for the well barrier(s). If the combined load measured exceeds the defined limit curve for the well barrier(s) 5 on the well in question the electronic unit 20 will trigger a disconnect of a releasable connector in the riser.

One embodiment of the electronic combined loading weak link according to the present invention comprises a sensor 18 pipe with an electronic processing unit 20 which interprets the combined loading condition in the sensor pipe 18. The limiting combined load in the sensor pipe is developed to ensure the integrity of the well barrier(s) (ref. FIG. 9 and FIG. 10) and is given as input to the electronic processing unit. If the combined load in the sensor pipe 18 exceeds the defined allowable limit, the unit will activate a mechanical, electric or hydraulic trigger which will disengage a releasable connector 6 in the riser 2.

A standard connector principle may be modified with a release mechanism 11 using a hinged and split cam ring 7 and a spring loaded locking pin 8 as illustrated in FIG. 11-FIG. 16. The locking pin 8 may also be energized using any sort of hydraulic arrangement. The split cam ring 7 is pre-tensioned to engage connector dogs 9 with sufficient force as for a normal connector design. In order to accommodate a disconnect function the split cam ring 7 is hinged in two or more locations. It is understood that the number of hinges may be higher or lower, for example 3, 4, 5, 6, or any other suitable number. At least one of the hinges is connected by an energized locking pin 8. The locking pin 8 is energized with sufficient force to ensure that the locking pin can be retracted from the split cam ring 7 when the split cam ring 7 is pre-tensioned up to it's maximum design load. According to one embodiment the locking pin 8 is energized by a loaded mechanical spring 10. Alternatively a pressurized hydraulic system with electronically actuated valves may equally well be used. Pure electric retraction of the locking pin 10 may be another option. Several alternative principles for retracting the locking pin are illustrated in FIG. 12. The locking pin 8 holds the split cam ring 7 together as long as the locking pin 8 is in place. In order to disconnect the riser 2, the locking pin 8 in the split cam ring 7 is released by releasing the mechanical spring 10, alternatively by opening a hydraulic valve, or any other suitable method for retracting the locking pin 8. The locking pin 8 is then pulled out and cleared from the split cam ring 7, which will then open up due to the tension forces in the system. The connector dogs 9, which hold the flanges of two riser sections together, are then free to rotate, and the tension in the riser 2 will ensure that the flange faces 11 of the riser sections are pulled apart, and the riser 2 is disconnected from the well. Radial springs (not shown) may be incorporated into the split cam ring 7 in order to ensure that the split cam ring 7 opens up when the locking pin 8 is retracted. It is understood that a releasable latching mechanism (not shown) may be used instead of locking pin 8.

The disconnect sequence is illustrated in FIG. 14 and FIG. 15.

In the case that an umbilical line 12 is deployed along the riser, for example during work over applications using a work over riser (WOR), umbilical release is ensured by applying tight umbilical clamps 13 in the region immediately above and below the electronic combined loading weak link connector, as shown in FIG. 16. This will ensure a concentrated load/strain in the umbilical 12 at the location of the connector. The strain concentration will cause the umbilical 12 to tear off when the electronic combined loading weak link connector is released. Tearing off the umbilical 12 will initiate a shut down sequence, securing the well barrier(s) 5. For umbilical designs not suitable for being torn off by axial loads, a spring loaded shear ram mechanism may be used to cut the umbilical. The shear ram may be triggered by an actuator similar to the one used to release the locking pin 8. Alternative configurations of such a shear ram for umbilical cutting are illustrated in FIG. 16.

According to one embodiment of the present invention, again with reference to FIG. 11 a sensor pipe 18 may comprise a machined pipe section which is provided with for example three separate and complete instrument packages 19. The instrument packages 19 may for example comprise a number of strain gauges, a number of temperature gauges and/or a number of pressure gauges or strain gauges set to measure hoop stress used to deduct internal over pressure. Each instrumentation package 19 will primarily be fitted around the circumference of the sensor pipe 18, but may also be fitted in alternative configurations. An electronic processing unit 20 will continuously monitor signals from the sensors in each of the (e.g. three or more) instrumentation packages 19 on the sensor pipe 18.

According to one embodiment, the signals may be processed by a voting system in order to ensure that only functioning sensors are interpreted by the system. The signals will further be used in an algorithm developed to monitor the combined loading in the pipe. Pressure measurements will be used in an algorithm to ensure that the device works equally well if the riser is unpressurized or if the riser is fully pressurized to its design pressure. The electronic processing unit 20 may be designed according to the appropriate Safety Integrity Level (SIL) as required by the relevant authorities to ensure sufficient system reliability. According to one embodiment of the present invention, the electronic unit may be designed according to SIL2 requirements to ensure sufficient reliability of the system, but higher or lower levels of safety performance may be chosen according to need, requirement and/or preference.

According to the present invention, the measurement of the measurement data relating to at least one of tension loads, bending loads, internal pressure loads and temperature, may be continuously or discontinuously received and processed by the electronic processing unit (20). Furthermore, the electronic processing unit (20) may continuously or discontinuously determine the combined load in the riser string or hose (2), and compares the determined combined load with the pre-defined allowable combined load capacity of the well barrier(s) (5) or other interfacing structure(s).

A release curve, of which two examples are given in FIG. 9 and FIG. 10, can be given as an input to the electronic unit 20 for each specific field or project. Thus the Safety Device according to the present invention is suitable for operation on any field, as the release curve may be tailored for each individual location and application.

The purpose of the instrumentation packages 19 on the sensor pipe 18 is to capture the internal pressure, the bending moment and the axial tension of the weak link detector pipe. To do this, the following sensors would, according to one possible embodiment, be needed:

- For redundancy, 3 independent measuring sections are recommended. Each measuring section may contain:
  - 4 strain measuring points including strain gauge rosettes located at for example 0°, 90°, 180° and 270° around the circumference of the sensor pipe 18. Each point must contain strain gauges in both the axial and the hoop direction.
  - Temperature sensor(s).
- An electronic processing unit containing:
  - Logics to process the strain and temperature measurements from each measuring section mentioned above;
  - A voting system for selecting between the measuring sections.

An example of each step necessary to carry out one embodiment of the present invention is outlined in the following. It is understood that the specific steps and methods to deduce the various results may vary and that the person skilled in the art with the benefit of the present teachings may chose to simplify, rewrite, add, or exclude certain terms and/or parameters in the following exemplary equations and steps.

1. Conversion of Measured Strain to Stress:

The surface of the pipe where the strain gages are located is in a plane stress condition. The following equations apply for converting the local strain and temperature at the pipe outer surface to local stress:

$$\sigma_z = \frac{E}{1-\nu^2}(\varepsilon_z + \nu\varepsilon_\theta) - \frac{E\alpha\Delta T}{1-\nu} \quad \text{(Axial stress)}$$

$$\sigma_\theta = \frac{E}{1-\nu^2}(\varepsilon_\theta + \nu\varepsilon_z) - \frac{E\alpha\Delta T}{1-\nu} \quad \text{(Hoop stress)}$$

Where:

$\sigma_z$—Axial stress $\sigma_\theta$—Hoop stress $\epsilon_z$—Axial strain $\epsilon_\theta$—Hoop strain E—Young's modulus $\nu$—Possion's ratio $\alpha$—Thermal expansion coefficient $\Delta T$—Temperature difference relative to reference temperature These equations will cover the situation with constant temperature over the cross section. The strain contribution from temperature changes will be compensated for in the algorithm based on the temperature measured by the temperature sensor(s).

2. Convert Surface Stress to Pressure, Tension and Bending Moment

The following equations may be used to convert from stress at pipe surface to effective tension, internal pressure and bending moment (index 0°, 90°, 180° and 270° indicates position around circumference):

$$M_x = \frac{(\sigma_{z,90^\circ} - \sigma_{z,270^\circ})}{2} \times \frac{\pi}{32D_o} \times (D_o^4 - D_i^4) \quad \text{(Bending about local x-axis)}$$

$$M_y = \frac{(\sigma_{z,0^\circ} - \sigma_{z,180^\circ})}{2} \times \frac{\pi}{32D_o} \times (D_o^4 - D_i^4) \quad \text{(Bending about local } y\text{-axis)}$$

-continued $$M_{Tot} = \sqrt{M_x^2 + M_y^2} \quad \text{(Combined bending moment)}$$

$$T = \frac{\begin{pmatrix} \sigma_{z,0^\circ} + \sigma_{z,90^\circ} + \\ \sigma_{z,180^\circ} + \sigma_{z,270^\circ} \end{pmatrix}}{4} \times \frac{\pi}{4}(D_o^2 - D_i^2) \quad \text{(True wall tension)}$$

$$T_e = T - p_i \times \frac{\pi}{4} D_i^2 \quad \text{(Effective tension)}$$

$$p_i = \frac{\begin{pmatrix} \sigma_{\theta,0^\circ} + \sigma_{\theta,90^\circ} + \\ \sigma_{\theta,180^\circ} + \sigma_{\theta,270^\circ} \end{pmatrix}}{4} \times \frac{1 - \left(\frac{D_i}{D_o}\right)^2}{2\left(\frac{D_i}{D_o}\right)^2} \quad \text{(Internal pressure)}$$

3. Failure Functions and Weak Link Release Criteria

To establish a logical signal giving failure/no failure, a range of failure functions may be used. These failure functions may trigger on single loads or a combination of different loads depending on existing limitations in the equipment. The following combined failure function may be used:

$$f = \frac{T_e}{F_s \times T_{max}} + \frac{M_{tot}}{F_s \times M_{max}} + \frac{p_i}{F_s \times p_{max}}$$

Where:

$F_s$—An overall safety factor (defined by operator or regulations $T_{max}$—Is the maximum allowable tension in the weak link (typically set to the tension capacity of the limiting barrier component)

$M_{max}$—Is the maximum allowable bending moment in the weak link (typically set to the bending capacity of the limiting barrier component)

Release should be triggered when the failure function exceeds 1. Typically $T_{max}$ and $M_{max}$ will be project specific and will be given as input to the weak link algorithm for a specific wellhead system to define the appropriate release limit for that well.

The instrumentation of the riser can be performed with any type of commercially available measuring device. The measurement can be based either on systems measuring local strain on the riser surface or it can be a system measuring displacement/deformation of the riser structure over a defined length.

Tension in the system is typically measured with strain gauges which are fixed to the riser surface and measures strain on the riser surface. Strain gauges are typically based on measuring changes in the electrical resistance in the material as the length and/or shape of the spools shown on the figure changes with material deformation.

Tension can also be measured by measuring the global elongation of the riser of a pre-defined length segment. This can be done by measuring change in conductivity in a pre-tensioned electrical wire, optically with laser systems, or with other commercial systems that also are available.

Bending moment in the riser can be done by combining strain measurements around the cross section of the riser to separate the bending strains from the axial strains in the pipe. Alternatively, the curvature in the riser of a pre-defined length segment can be measured directly by measuring changes in the electrical conductivity of specially developed curvature measurement bars.

The pressure in the pipe can be measured through a conventional pressure gauge measuring the internal pressure in the riser. Alternatively, the pressure can be extracted by measuring the hoop strain in the pipe using strain gauges.

According to one embodiment of the present invention, traditional strain gauges are used for all measurements as these currently are the most reliable over time. If or when other strain gauging devices prove to be as reliable or more reliable over time, these may equally be used to make the necessary measurements.

When it comes to details around the arrangement of the split cam ring 7, the connector dogs 9 and the release mechanism 10, there are several alternative solutions according to the present invention. As an example, the actuator may be designed to give an instant release of a force up to 80 T. It is envisioned that the force of 80 T will primarily come from a pre-tensioned spring mechanism. Alternatively this force could also be provided by a hydraulic actuator or even from an electrical motor. To release the locking pin 8, one of the following principles may be utilized (as also illustrated in FIG. 12):

- An electric switch or a magnet that releases an over-center mechanism which triggers the release of the 80 T force.
- An electric motor which frees the locking pin 8.
- A hydraulic system that opens a hydraulic valve thereby applying hydraulic pressure from a pre-charged accumulator to release the locking pin 8.

The electronic combined loading weak link according to the present invention may also find other applications. For a typical test production (extended well testing) through a drill pipe or a WOR riser the weak link may be directly applicable also for production risers. For offloading hoses the electronic combined loading weak link according to the present invention would need to be configured for relevant accidental scenarios for the particular application. However, the same principles for combining electronic measurements into a combined loading formula which is compared continuously against a defined limit, and for triggering a connector release when necessary, are generally applicable. It should be noted that in particular for offloading systems there is normally a focus on having valves on the connector to prevent pollution from the hose in a disconnect scenario. This is not required for a WOR riser as a weak link release would be the very last resort to prevent accidents at a much larger scale.

The present invention offers a number of possible advantages as compared to the conventional solutions that are in use today. Operational envelopes can be increased significantly during C/WO operations as static offset in operation does no longer affect the weak links ability to protect the well barrier(s), ref. FIG. 4. Each supplier can in principle qualify one weak link which can be used on any C/WO system and the release settings can be set for each specific project. The increase in the operating envelope is particularly important for work over operations performed from a dynamically positioned vessel, but will also apply to anchored vessels.

In the case of a heave compensator 1 lock up, which creates excessive bending in the well barrier(s) 5 with rig offset, the allowable offset is usually limited. With a combined loading weak link according to the present invention, this limitation can be removed, and the weak link will protect the well barrier(s) against any combined load scenario. Hence, the combined loading weak link according to the present invention will also cover excessive vessel offset and thus will protect well barrier(s) for all accidental scenarios requiring a sudden disconnect of the workover riser.

The safety level during C/WO operations, in particular from DP operated vessels, will be improved considerably as the combined loading weak link according to the present invention monitors and considers the accurate combined load that arises in the riser 2 and well barrier(s) 5. The combined loading weak link according to the present invention is able to protect the well barrier(s) 5 in case of compensator lock-up, vessel drift-off or vessel drive-off or any combination of these scenarios.

The combined loading weak link according to the present invention does not rely on structural failure in any component and is therefore not relying on specific material batches that need project specific qualification. Such project specific qualification schemes have proven to be expensive, time consuming and in some respects unreliable. With the combined loading weak link according to the present invention, stringent project qualification schemes can be carried out with only non-destructive testing.

The combined loading weak link according to the present invention considers tension loading and bending loads as well as any combination of these loads with better accuracy than existing weak link designs which are primarily suitable for pure tension or pure bending loads only.

The combined loading weak link according to the present invention uses the pressure in the system in the combined loading analysis. Thus, it is no longer a challenge to fulfill all design requirements when the system is pressurized and at the same time ensure safe release when the system is unpressurized.

The release settings of combined loading weak link according to the present invention can be adjusted with "push button" functionality and is not reliant on any structural design work or manufacturing of new components when being used on a new project with new design criteria.

The combined loading weak link according to the present invention can be electronically tested on deck to ensure full functionality on deck immediately before use.

The invention claimed is:

1. A safety device for protection of the integrity of well barrier(s) or other interfacing structure(s) at an end of a riser string or a hose, the safety device comprising a releasable connection in the riser string or hose, the releasable connection arranged to release or disconnect during given predefined conditions in order to protect the well barrier(s) or other interfacing structure(s), wherein the safety device comprises:

at least one sensor to monitor at least one of tension loads, bending loads, internal pressure loads and temperature, where said at least one sensor is arrangeable on a segment of the riser or hose, and where said at least one sensor is adapted to provide measured data relating to at least one of tension loads, bending loads, internal pressure loads and temperature, an electronic processing unit adapted to receive and interpret the measured data from said at least one sensor, an electronic, hydraulic or mechanical actuator or switch arranged to receive a signal from the electronic processing unit and initiate a release or disconnect of the releasable connection, wherein the electronic processing unit is configured to autonomously send the signal to the electronic, hydraulic or mechanical actuator or switch when the measured data is indicative of the given predefined conditions.

2. Safety device according to claim 1, wherein said at least one sensor to monitor at least one of tension loads, bending loads, internal pressure loads and temperature is arranged close to the well barrier(s) or the end(s) of the riser string or hose in order to allow reliable measurements of riser string or hose bending moments or deflection angles.

3. Safety device according to claim 1, wherein said at least one sensor to monitor at least one of tension loads, bending loads, internal pressure loads and temperature comprises any number and/or any combination of one or more of the following sensors or measuring devices:

strain gauges potentiometers optic displacement sensors pressure gauges temperature gauges in order to ensure the reliability of the measured data.

4. Safety device according to claim 1, wherein the electronic processing unit, if it receives measured data from a number of sensors providing overlapping results, comprises a voting system arranged to select what results to apply in order to ensure that only reliable results are interpreted by the system.

5. Safety device according to claim 1, wherein the releasable connection comprises a split cam ring with a number of rotating connector dogs, where the releasable connection is arranged to hold together the flanges of two riser string or hose sections, and where the split cam ring of the releasable connection further comprises two or more hinges to close the split cam ring around the flanges, where one or more of the hinges comprises: 1) a removable locking pin so that the cam ring is split to release the grip on the connector dogs by removing the locking pin, or 2) a releasable latching mechanism so that the cam ring is split to release the grip on the connector dogs by opening the latch mechanism in one of the hinged elements of the cam ring.

6. Safety device according to claim 1, wherein it comprises a disengagement mechanism to ensure disengagement of any control umbilical running along the riser string or hose and which needs to be disconnected together with the riser string to protect the integrity of the well barrier(s) or other interfacing structure(s), the disengagement mechanism comprising one or more of the following:

an electrically activated over-center mechanism to release a spring loaded cutting tool, an electrically driven release of an energized cutting tool, a hydraulically driven cutting tool, a clamping device for securely clamping the umbilical to the riser string or hose, and furthermore arranged to tear off the umbilical when the riser string or hose is separated.

7. Safety device according to claim 1, wherein the electronic processing unit is without any external power supply or control signals going into the electronic processing unit during operation.

8. Safety device according to claim 1, wherein the electronic processing unit is arranged in the vicinity of the releasable connection and/or said at least one sensor.

9. Safety device according to claim 1, wherein the electronic processing unit is arranged remotely from the releasable connection and/or said at least one sensor.

10. Safety device according to claim 1, wherein the electronic processing unit is connected to an actuator mechanism which upon signal will trigger a disengagement of the releasable connection in the riser string or hose, wherein the actuator mechanism is one or more of:

an electric switch, electric or magnetic release of a spring loaded over-center mechanism, electric or mechanical opening or closing of hydraulic valves to trigger a hydraulic release mechanism.

11. Safety device according to claim 1, wherein the releasable connection comprises a number of connector dogs that hold the flange faces in the riser string together at a certain pretension level in order to provide the required seal pressure between the flange faces, and wherein the connector dogs are free to rotate in order to allow the flange faces to be pulled apart when the connector dogs are released, even under high loads.

12. Safety device according to claim 6, wherein the locking pin and/or latching mechanism securing the split cam ring during nounal operation is energized using either a mechanical spring or a pressurized hydraulic unit, where the energy in the spring or hydraulic unit is arranged to be released by the actuator, causing the locking pin to be removed from the split cam ring, thereby causing the split cam ring to separate and disengage from the connector dogs.

13. Safety device according to claim 2, wherein the electronic processing unit, if it receives measured data from a number of sensors providing overlapping results, comprises a voting system arranged to select what results to apply in order to ensure that only reliable results are interpreted by the system.

14. Safety device according to claim 3, wherein the electronic processing unit, if it receives measured data from a number of sensors providing overlapping results, comprises a voting system arranged to select what results to apply in order to ensure that only reliable results are interpreted by the system.

15. Method for providing protection of the integrity of well barrier(s) or other interfacing structure(s) at an end of a riser string or a hose, the method comprising the step of providing a releasable connection in the riser string or hose, where the releasable connection is arranged to release or disconnect during given predefined conditions in order to protect the well barrier(s) or other interfacing structure(s), and where the releasable connection is provided between two riser string or hose sections or between the riser and any other part interfacing the riser string or hose, the method being wherein it further comprises the steps of:

a) monitoring and measuring loads in the riser string or hose related to at least one of tension loads, bending loads, internal pressure loads and temperature, and providing measurement data, b) determining a combined load on the riser string or loading hose, and the well barrier(s) or other interfacing structure(s) to the riser string or hose on the basis of the measurement data using a processing unit, c) comparing the determined combined load based on the measurement data with a pre-defined allowable combined load capacity using the processing unit, and, if the determined combined load based on the measurement data exceeds the pre-defined allowable combined load capacity:

d) the processing unit autonomously sending a signal to the releasable connection, and e) disconnecting the riser string or hose from the well barrier(s) or other interfacing structure(s) in response to the signal.

16. Method according to claim 15, wherein the step of providing measurement data in the riser string or hose is continuously or discontinuously received and processed by an electronic processing unit, wherein the electronic processing unit continuously or discontinuously, respectively, determines the combined load in the riser string or hose, and compares the determined combined load with the pre-defined allowable combined load capacity of the well barrier(s) or other interfacing structure(s).

17. Method according to claim 15, wherein the capacity of the structure at either end of the riser string or hose is defined as a combined load capacity curve covering any relevant combination of tension load, bending load, internal pressure load and temperature in the riser string or hose, as well as the relative angle between the riser string or hose and the well barrier(s) or other interfacing structure(s).

18. Method according to claim 15, wherein the combined load in the riser string or hose is evaluated according to the following equation:

$$f = \frac{T_e}{F_s \times T_{max}} + \frac{M_{tot}}{F_s \times M_{max}} + \frac{p_i}{F_s \times p_{max}}$$

where:

$F_s$—is an overall safety factor as defined by operator or regulations, $T_{max}$—is the maximum allowable tension in the releasable connection and typically set to the tension capacity of the limiting barrier component, $M_{max}$—is the maximum allowable bending moment in the releasable connection and typically set to the bending capacity of the limiting barrier component.

19. Method according to claim 18, wherein the monitored and measured loads related at least one of tension loads, bending loads, internal pressure loads and temperature somewhere along the riser string or hose, are converted to local surface stress parameters according to the equations:

$$\sigma_z = \frac{E}{1-\nu^2}(\varepsilon_z + \nu\varepsilon_\theta) - \frac{E\alpha\Delta T}{1-\nu}$$

$$\sigma_\theta = \frac{E}{1-\nu^2}(\varepsilon_\theta + \nu\varepsilon_z) - \frac{E\alpha\Delta T}{1-\nu}$$

where:

$\sigma_z$—axial stress $\sigma_\theta$—hoop stress $\epsilon_z$—axial strain $\epsilon_\theta$—hoop strain E—Young's modulus $\nu$—Possion's ratio $\alpha$—thermal expansion coefficient $\Delta T$—temperature difference relative to reference temperature these equations covering the situation with constant temperature over the cross section, and temperature induced strain compensated for in the equations by using the materials coefficient of temperature expansion and the measured temperature.

20. Method according to claim 19, wherein the local surface stress parameters are converted to internal pressure, effective tension and bending moment parameters according to the following equations, where an index 0°, 90°, 180° and 270° indicates the position around the circumference of the riser string or hose:

$$M_x = \frac{(\sigma_{z,90^\circ} - \sigma_{z,270^\circ})}{2} \times \frac{\pi}{32D_o} \times (D_o^4 - D_i^4) \quad \text{(Bending about local x-axis)}$$

$$M_y = \frac{(\sigma_{z,0^\circ} - \sigma_{z,180^\circ})}{2} \times \frac{\pi}{32D_o} \times (D_o^4 - D_i^4) \quad \text{(Bending about local } y\text{-axis)}$$

$$M_{Tot} = \sqrt{M_x^2 + M_y^2} \quad \text{(Combined bending moment)}$$

$$T = \frac{\begin{pmatrix} \sigma_{z,0^\circ} + \sigma_{z,90^\circ} + \\ \sigma_{z,180^\circ} + \sigma_{z,270^\circ} \end{pmatrix}}{4} \times \frac{\pi}{4}(D_o^2 - D_i^2) \quad \text{(True wall tension)}$$

$$T_e = T - p_i \times \frac{\pi}{4} D_i^2 \quad \text{(Effective tension)}$$

$$p_i = \frac{\begin{pmatrix} \sigma_{\theta,0^\circ} + \sigma_{\theta,90^\circ} + \\ \sigma_{\theta,180^\circ} + \sigma_{\theta,270^\circ} \end{pmatrix}}{4} \times \frac{1 - \left(\frac{D_i}{D_o}\right)^2}{2\left(\frac{D_i}{D_o}\right)^2} \quad \text{(Internal pressure).}$$

* * * * *